United States Patent [19]

Hwang

[11] Patent Number: 4,972,525

[45] Date of Patent: Nov. 27, 1990

[54] UNDERPANTS WITH SMOOTH SIDES

[76] Inventor: Ying-Teh Hwang, No. 220, Ruey Feng Street, Kaohsiung, Taiwan

[21] Appl. No.: 424,738

[22] Filed: Oct. 20, 1989

[51] Int. Cl.[5] ..... A41B 9/00

[52] U.S. Cl. ..... 2/406; 2/403; 2/2; 450/117; 450/132

[58] Field of Search ..... 2/2, 402, 403, 404, 2/406, 407; 450/112, 115, 117, 132, 133, 135, 138, 139, 140, 141, 142, 143, 144, 151

[56] References Cited

U.S. PATENT DOCUMENTS

| | | | |
|---|---|---|---|
| 1,353,750 | 9/1920 | Heitter | 2/406 X |
| 1,494,044 | 5/1924 | Ward et al. | 2/406 |
| 1,562,252 | 11/1925 | Laster | 2/407 |
| 2,137,163 | 11/1938 | Imershein | 450/151 |
| 2,424,651 | 7/1947 | Dubner | 450/132 X |
| 2,462,195 | 2/1949 | Jacobson | 2/406 |
| 2,527,543 | 10/1950 | Godbout | 450/132 |
| 2,538,596 | 1/1951 | Sheridan | 2/406 |
| 2,563,308 | 8/1951 | Chase et al. | 450/117 X |
| 2,630,570 | 3/1953 | Herbener | 450/143 X |
| 2,702,903 | 3/1955 | Gourdon | 450/117 X |
| 3,068,488 | 12/1962 | Rodriguez | 2/406 X |
| 3,087,495 | 4/1963 | Hart | 2/406 X |
| 3,909,847 | 10/1975 | Holt et al. | 2/2 |
| 4,462,115 | 7/1984 | Carlson et al. | 2/406 X |

FOREIGN PATENT DOCUMENTS

| | | | |
|---|---|---|---|
| 1932606 | 1/1971 | Fed. Rep. of Germany | 2/406 |
| 3638718 | 8/1987 | Fed. Rep. of Germany | 2/2 |
| 1073126 | 9/1954 | France | 450/151 |
| 1103969 | 11/1955 | France | 2/406 |
| 1408821 | 4/1962 | France | 2/406 |
| 46259 | 6/1939 | Netherlands | 2/406 |
| 2136675 | 9/1984 | United Kingdom | 2/2 |

*Primary Examiner*—Werner H. Schroeder
*Assistant Examiner*—Jeanette E. Chapman
*Attorney, Agent, or Firm*—Bacon & Thomas

[57] ABSTRACT

An underpants provided with smooth side panels free of protruding edges and elastic bands cover the iliac crests on both sides of the wearer for providing comfort during sleeping on either side, minimize waistband discomfort and render the sides of the underpants inconspicuous when worn under a pair of trousers or skirt.

2 Claims, 2 Drawing Sheets

UNDERPANTS WITH SMOOTH SIDES

BACKGROUND OF THE INVENTION

This invention concerns a structure of underpants having smooth sides without any protruding edges.

Ordinary underpants used nowadays have a structure showed in FIG. 1, comprising an underpant body cloth 11, an elastic waistband 20, and elastic leghole bands 30. Then underpants are kept elastically on a human body by the waistband 20 and the leghole bands 30, which are thicker than the underpant body cloth 11, forming a kind of protruding edges.

But the inventor has deemed, from the viewpoint of the structure of a human body, that this traditional underpants 10 have the following drawbacks.

1. The belly and the lower back where the underpants contact with are comparatively flat with fat and flesh, but the right and the left sides have iliac crests and curves so that they may receive larger force of the elasticity of the waistband, and thereby they are sure to be felt the most hurt after a long time of wearing, especially if the underpants are new or have a tight waistband. Therefore, these underpants can make a human body tired and give a bad influence to the blood circulation, impairing human health.

2. If a person sleeps on his/her side, this kind of underpants have its waistband 20 tightly oppress his/her side, forced by a large pressure of a bed surface, and thereby it can cause discomfort of his/her body or even sleeplessness or insomnia.

3. The right and the left side sections of the waistband can comparatively protrude out so that a pair of trousers or a skirt worn on the underpants can appear a little swelled up at both sides where the waistband is, with a resultant bad appearance.

SUMMARY OF THE INVENTION

In view of the shortcomings of conventional underpants, this invention has been devised to improve them.

The underpants with smooth sides in accordance with the present invention comprise an underpant body, an elastic waistband at the upper circumferential edge, and a right and a left side cloth without any protruding edges.

As both the side cloths are smooth without any protruding edges, they can not oppress the iliac crests on both sides, and thereby a person can feel comfortable, wearing this underpants.

DETAILED DESCRIPTION OF THE INVENTION

Figure 3:
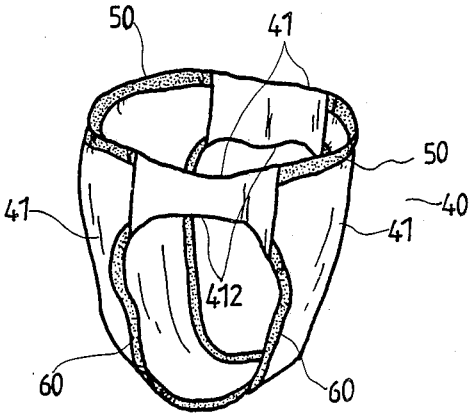
FIG. 3 is a perspective view of the underpants with smooth sides in accordance with the present invention.

The underpants with smooth sides in accordance with the present invention, as shown in FIG. 3, comprise an underpant body 41, an elastic waistband 50 at the upper circumferential edge, and a right and a left side cloth 412 with a upper edge 411 having no protrusions at all. The right and the left side cloth 412 just cover and contact with both the iliac crests at both sides. Both the legholes have an elastic band 60 at their circumferential edges.

Figure 1:
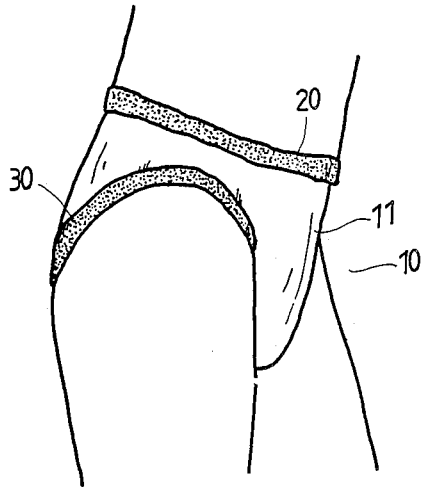
FIG. 1 PRIOR ART
FIG. 1 is a perspective view of ordinary underpants.
Figure 2:
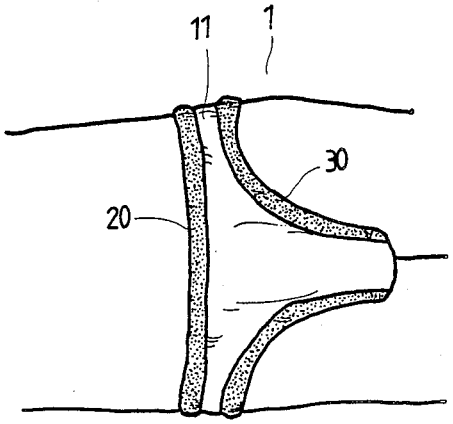
FIG. 2 PRIOR ART
FIG. 2 is a perspective view of ordinary underpants worn and laid on side.
Figure 4:
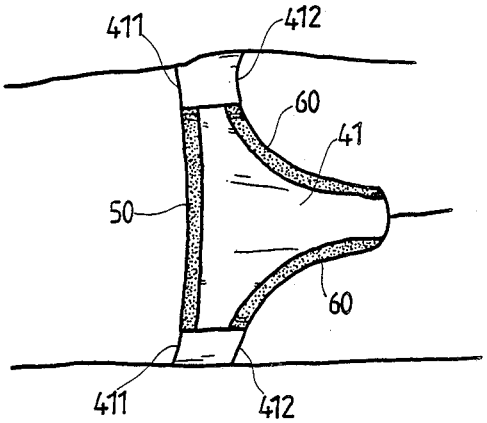
FIG. 4 is a perspective view of this underpants worn and laid on side.

The elastic bands terminate at the side cloths as shown in FIGS. 3 and 4.

When a person wearing this underpants lies down on his/her side as shown in FIG. 4, whether on the right or the left side, there is not any protrusions on the sides of the underpants to oppress the body as to impair the blood circulation. When a person wearing this underpants is standing, both sides of the underpants does not give special pressure on the body so that he/she may feel more comfortable without feeling any contraction on the body.

What is claimed is:

1. An underpants comprising:

(a) a main body section for extending between the front and rear portions of the wearer;

(b) the main body portion including two opposed pairs of spaced side edges, elastic means defining a waistband and a pair of leg holes;

(c) a pair of smooth side sections, each side section extending between and secured to each pair of side edges for extending across the iliac crest on each side of the wearer; and (d) the elastic means terminating at said side sections.

2. The underpants of claim 1 wherein the:

(a) the main body section includes a pair of opposed waist edges and a pair of opposed leg hole edges; and (b) the elastic means includes an elastic band extending along each waist edge and each leg hole edge.

* * * * *